United States Patent [19]

McWhorter et al.

[11] Patent Number: 5,005,802

[45] Date of Patent: Apr. 9, 1991

[54] VARIABLE BORE PACKER FOR A RAM TYPE BLOWOUT PREVENTER

[75] Inventors: David J. McWhorter; Bolie C. Williams, III, both of Houston; Eric G. Childs, Katy; Gary R. Schaeper, Houston, all of Tex.

[73] Assignee: Cooper Industries, Inc., Houston, Tex.

[21] Appl. No.: 473,579

[22] Filed: Feb. 1, 1990

[51] Int. Cl.[5] ..... E21B 33/06

[52] U.S. Cl. ..... 251/1.3; 277/129; 277/188 A

[58] Field of Search ..... 251/1.1, 1.3; 277/129, 277/188 A, 235 R

[56] References Cited

U.S. PATENT DOCUMENTS

| | | | |
|---|---|---|---|
| 2,193,110 | 3/1940 | Penick et al. | 277/129 |
| 2,194,256 | 3/1940 | Allen | 277/129 |
| 2,194,259 | 3/1940 | Allen | 251/1.3 X |
| 2,446,224 | 8/1948 | Frisby et al. | 277/188 A |
| 3,897,071 | 7/1975 | LeRouax | 277/188 A |
| 3,915,426 | 10/1975 | LeRouax | 251/1 |
| 4,229,012 | 10/1980 | Williams, III | 277/127 |
| 4,332,367 | 6/1982 | Nelson | 277/188 A X |
| 4,456,215 | 6/1984 | Bishop et al. | 251/1.3 X |
| 4,579,314 | 4/1986 | Schaeper et al. | 251/1.2 |

*Primary Examiner*—John C. Fox

[57] ABSTRACT

A packer for use with a ram-type blowout preventer which has the capacity to accommodate a plurality of sizes of tubular members extending through the bore of the blowout preventer, the packer having a resilient body to fit the face recess of the ram and a central recess to receive a tubular member, an upper plate positioned in the upper portion of the resilient body, a lower plate positioned in the lower portion of the resilient body, a plurality of metal insert segments positioned between the upper surface of the resilient body and the under surface of the upper plate and around the central recess of the resilient body, the metal insert segments having sufficient length to engage the exterior of a tubular member which is to be engaged and sealed against by the resilient body with the insert segments being selected to seal against a preselected small tubular member diameter which is less than the diameter which could be sealed by the packer without the insert segments. The resilient body is provided with a relief area around its central recess immediately above the upper plate. In another form a second set of insert segments are provided to extend to a smaller diameter than the first set of insert segments.

4 Claims, 5 Drawing Sheets

VARIABLE BORE PACKER FOR A RAM TYPE BLOWOUT PREVENTER

BACKGROUND

The present invention relates to an improved blowout preventer packer which can be used for sealing against the exterior of different sizes of tubular members within a limited range as hereinafter set forth. Prior to the present invention there have been designs for allowing the blowout preventer packer to be actuated into sealing position which included expensive irising inserts or multiple component inserts which were tied together. While some of these prior art devices were capable of performing their design function, they were of complex structure and expensive to manufacture.

The B. C. Williams, III U.S. Pat. No. 4,229,012 discloses a variable bore packer for a ram-type blowout preventer in which the inserts embedded in the resilient packer were irising elements which each includes an upper plate, a lower plate and a rib connected between the upper and lower plates. Each of the plates is generally triangular in shape and designed to rotate as it moves inwardly with the resilient packer annulus so that the resilient material is supported when in sealing engagement with the exterior of a tubular string extending through the preventer. Also, a linkage structure is provided to allow the desired movement of the packer in sealing while maintaining its connection to the ram.

The G. R. Schaeper et al U.S. Pat. No. 4,579,314 discloses an annular type of blowout preventer in which the resilient annulus is provided with upper and lower insert plates embedded in the resilient annulus but is directed mainly to a side outlet in the body through which the annulus may be removed and replaced.

The R. K. LeRouax U.S. Pat. No. 3,915,426 discloses a ram-type variable bore blowout preventer in which a plurality of assemblies of pairs of spaced apart, radially extending plates, a single radially extending plate is held in position on one side of each pair of plates by a connector which is secured to the outer edges of each of the plates and has slots for the screws which connect to the pair of plates and such assemblies are positioned above and below the resilient packer to provide support and avoid extrusion of the resilient packer material when it is in sealing engagement with a tubular member and exposed to pressure below the preventer.

SUMMARY

The present invention relates to an improved ram-type blowout preventer packer which is capable of sealing on the exterior of tubular members of different sizes within a limited range of sizes. Each of the packers includes a resilient packer member of a suitable size and with means for connecting into the front slot of the ram, an upper plate embedded in the resilient packer material, a lower plate embedded in the resilient packer material to support the material within the ram slot, and a series of upper segments positioned in the packer material below the upper plate and being movable with the packer material as it moves forward during sealing. The segments move inward with the packer material in sealing to provide an upper anti-extrusion support for the packer material when it is set in sealing engagement around the exterior of a tubular string extending through the blowout preventer.

An object of the present invention is to provide an improved packer for a ram-type blowout preventer which can readily adapt to tubular strings of different sizes within a limited range and which is of simple, reliable structure.

Another object is to provide an improved variable bore packer for a ram-type blowout preventer which is relatively inexpensive to manufacture.

A further object is to provide an improved variable bore packer for a ram-type blowout preventer which has improved operation in the limited range in which it is to operate.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1:
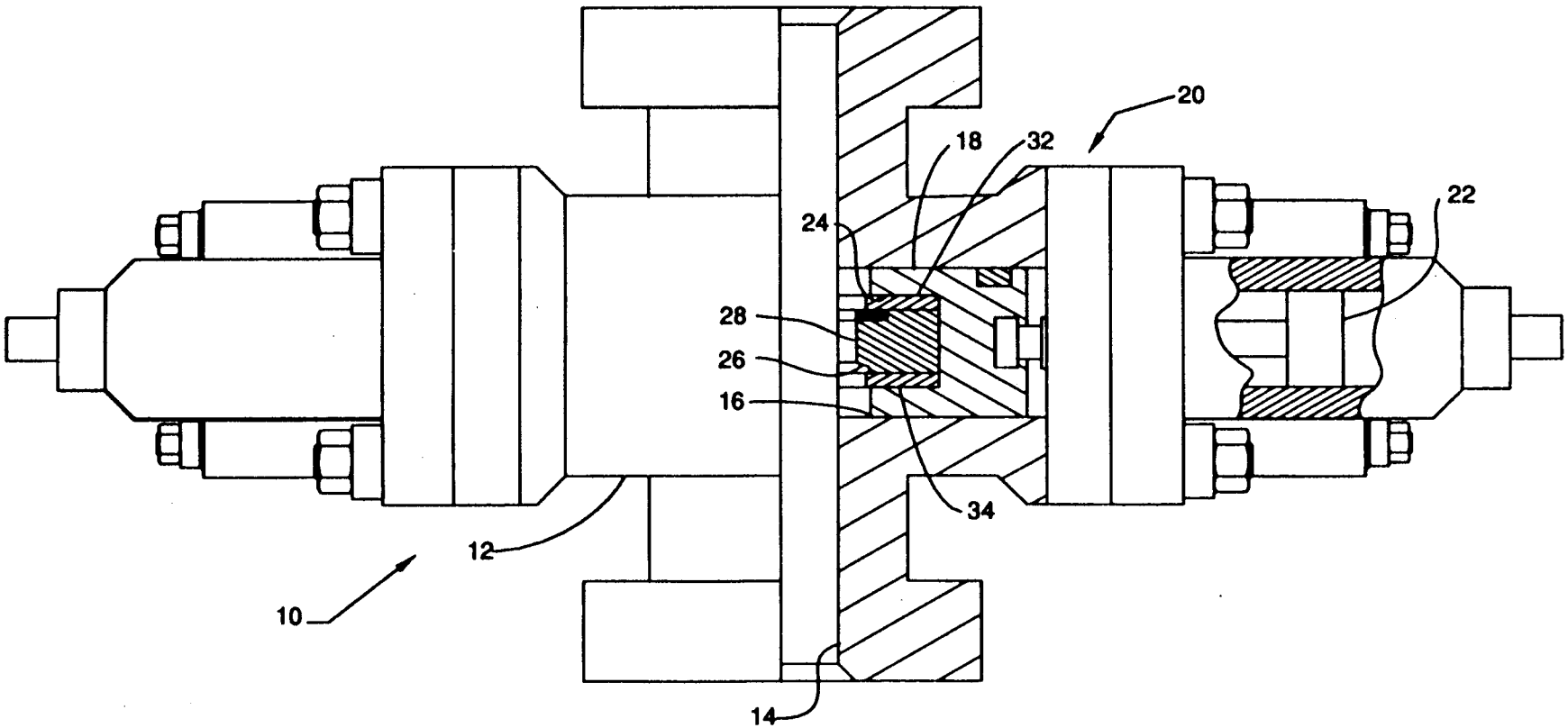
FIG. 1 is an elevation view, partially in section, of a ram-type blowout preventer on which the improved packer of the present invention has been installed.
Figure 2:
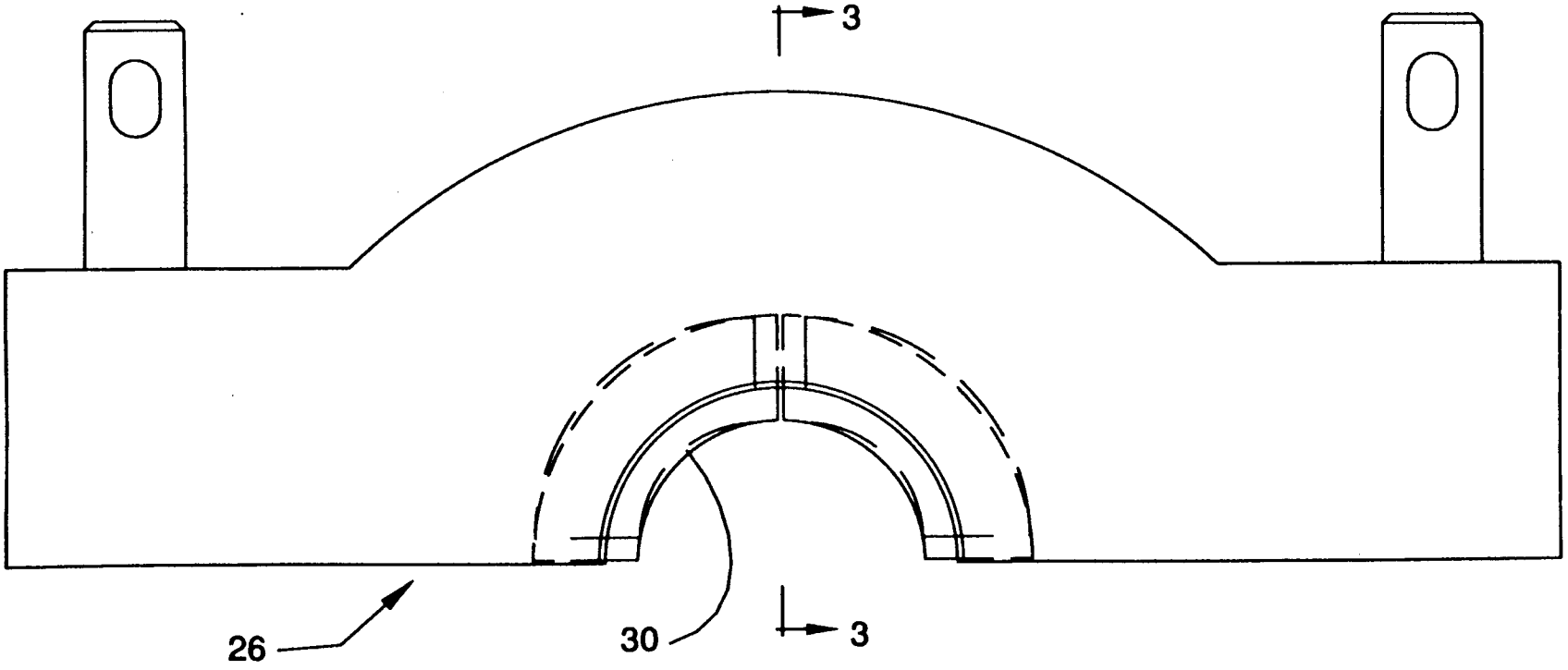
FIG. 2 is a plan view of one form of the improved packer of the present invention.
Figure 3:
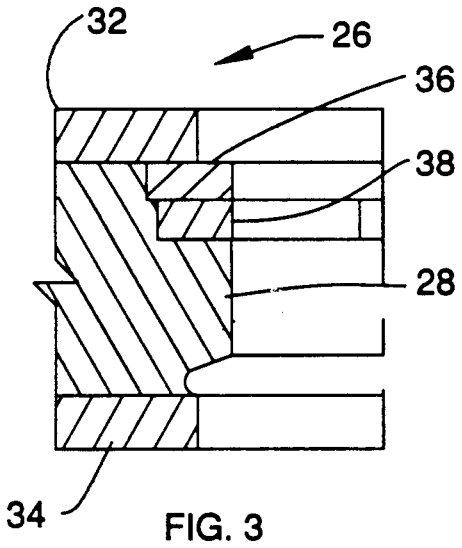
FIG. 3 is a partial sectional view of the improved packer taken along line 3—3 in FIG. 2 and illustrating the packer in its retracted position.

Ram-type blowout preventer 10 as shown in FIG. 1 includes body 12 having central bore 14 with opposed guideways 16 extending radially outward from bore 14. Blowout preventer 10 is similar to the blowout preventer illustrated on pages 926 through 938 of the 1986/87 Composite Catalog of Oilfield Equipment and which is known as the Cameron "U" BOP. Each ram 18 is positioned in its guideway 16 and is connected to suitable actuating means 20, such as piston 22, for moving rams 18 axially in their guideways 16. Each ram 18 includes front face slot 24 for receiving a suitable packer therein with means coacting with the packer for securing it within slot 24. Packers, other than packers on blind rams, normally are of a resilient material and function to engage and seal against the exterior of a tubular member which extends through central bore 14 and against which the ram packers are to close.

Improved packer 26, as shown in FIGS. 1 to 6, includes resilient body 28 with the usual packer shape including face recess 30, upper plate 32 and lower plate 34 embedded in body 28, upper series of insert segments 36 and lower series of insert segments 38, both of which are positioned, as shown, to have their inner ends open in face recess 30. Upper insert segments 36 are positioned immediately under upper plate 32 and lower insert segments 38 are positioned immediately under upper insert segments 36. Insert segments 36 should be free to move with the movement of body 28 with respect to upper plate 32. Both insert segments 36 and 38 should include a means for maintaining them in engagement with body 28 so that they are not released therefrom and fall into the central bore 14 to create junk problems in the well bore below blowout preventer 10.

In the preferred form of the inventions shown in FIGS. 1 to 6, insert plates 36 and 38 may be suitably bonded to the material of body 28 but care should be taken so that upper insert plates 36 are not bonded to upper plate 32 or to each other.

The sizes of insert plates 36 and 38 are preselected so that they will move into engagement with the exterior of a particular size of tubular member against which they are to engage to provide support for body 28 and to prevent extrusion of the material of body 28.

As shown in FIGS. 3 to 6, packer 26 is designed for sealing on a limited range of sizes of tubular members 39. For example, packer 26 can be sized to seal against pipe sizes of 2⅜" diameter, 2⅞" diameter and 3½" diameter. In this configuration upper and lower plates 32 and 34 would be sized to fit the 3½" diameter pipe 39*c*, insert segments 38 would be sized to fit the 2⅜" diameter pipe 39*a* and insert segments 36 would be sized to fit the 2⅞" diameter pipe 39*b*.

In sizing insert segments 36 and 38, not only is their inner radius sized to match the outside diameter of the pipe against which it is to seal and their radial length is sufficiently long to allow them to move into engagement with the pipe exterior and still provide the support for the resilient packer body 28 to avoid its extrusion. Another factor is the circumferential space between the individual insert segment is selected to be sufficient to allow the desired radial inward movement of the segments into their supporting position.

Figure 4:
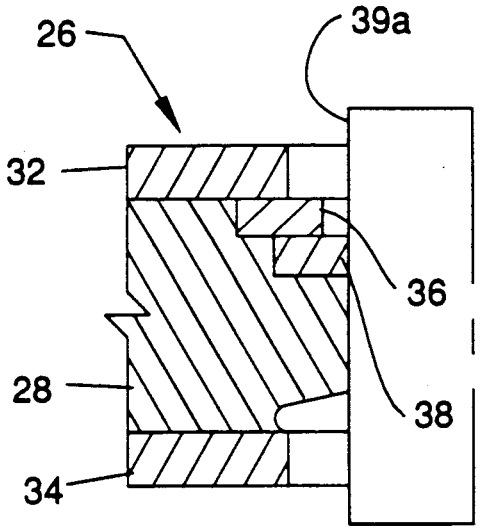
FIG. 4 is another partial sectional view of the packer similar to FIG. 3 and illustrating the packer in its sealed position against the smallest size of tubular string extending through the bore of the blowout preventer against which the packer is to seal.
Figure 5:
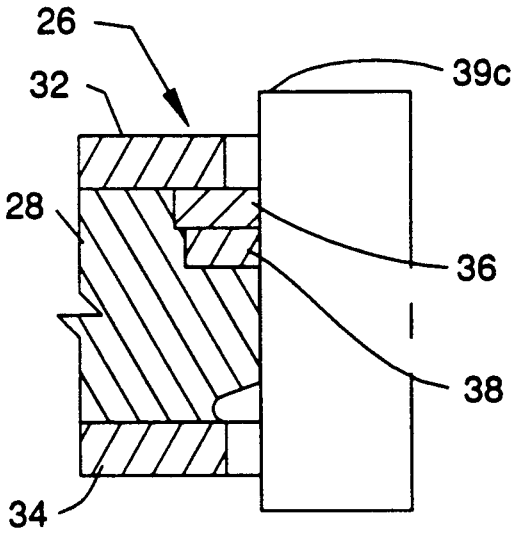
FIG. 5 is another partial sectional view of the packer similar to FIGS. 3 and 4 but illustrating the packer sealed against an intermediate size string.
Figure 6:
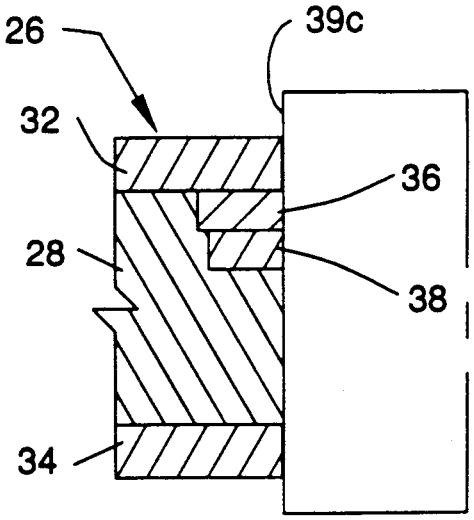
FIG. 6 is another partial sectional view of the packer similar to FIGS. 3, 4 and 5 but illustrating the packer sealed against the largest size string against which it is to seal.

The sealing position in the large diameter pipe 39*c* is shown in FIG. 6. The sealing position of packer 26 on the intermediate diameter pipe 39*b* is shown in FIG. 5. The sealing position of packer 26 on the small diameter pipe 39*a* is shown in FIG. 4.

Figure 7:
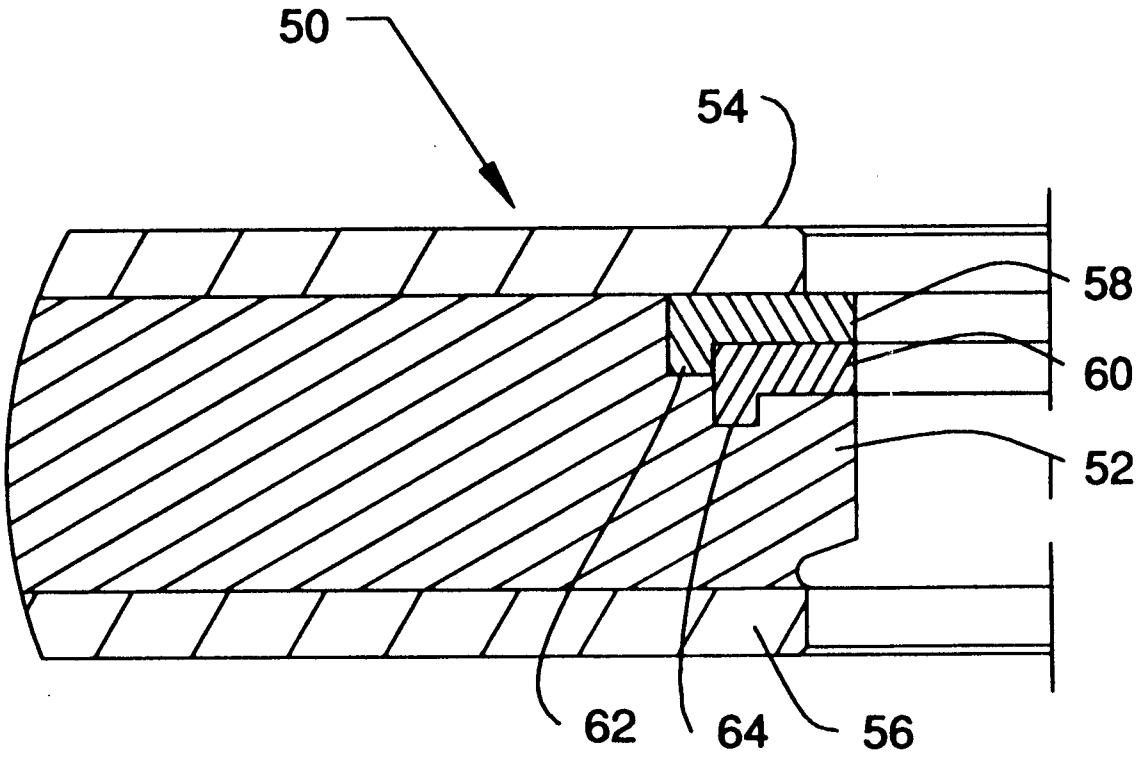
FIG. 7 is another partial sectional view of a modified form of packer of the present invention shown in its retracted or relaxed position.

Packer 50, shown in FIG. 7, is a modified form of packer 26 and is designed for use with three sizes of pipe or tubular members. Packer 50 includes resilient body 52, upper plate 54, lower plate 56, upper series of insert segments 58 and lower series of insert segments 60. It should be noted that packer 50 and packer 26 both have the usual means for securing them into position in the front face ram slot. Each of segments 58 includes depending outer lip 62 and each of segments 60 includes depending outer lip 64. As shown in FIG. 7, lips 62 and 64 are embedded in resilient body 52.

When packer 50 is in sealing position, plates 54 and 56 support body 52 against the large diameter pipe, upper insert segments 58 support body 52 against the intermediate diameter pipe and lower insert segments 60 support body 52 against the small diameter pipe.

Figure 8:
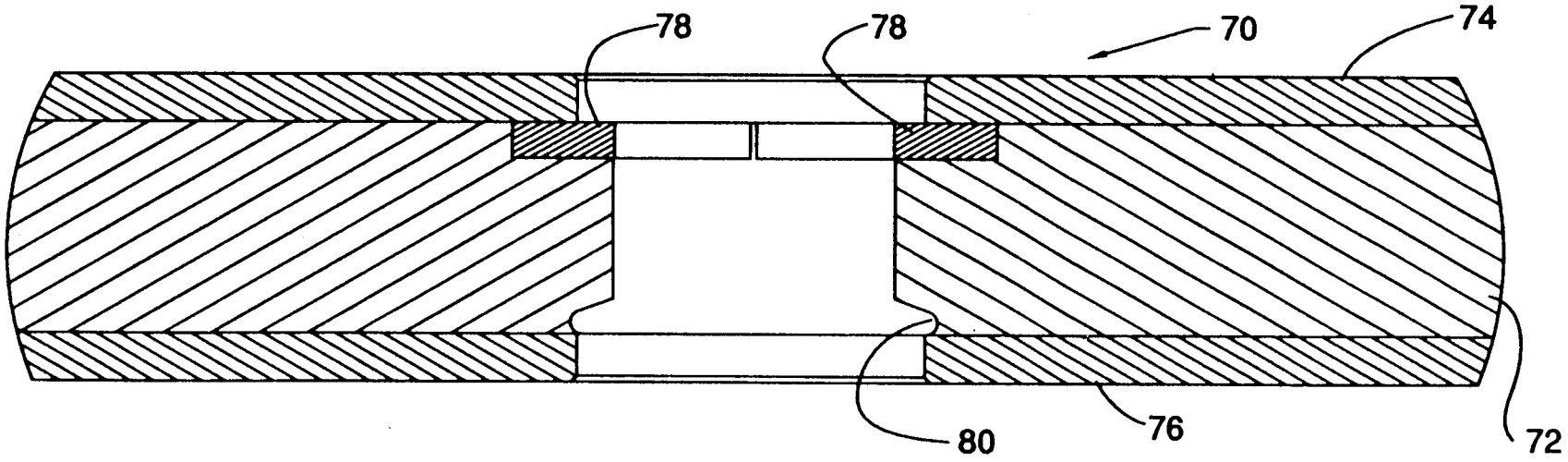
FIG. 8 is a partial sectional view of another modified form of packer in its retracted or relaxed position.

Packer 70, shown in FIG. 8, is another modified form of packer of the present invention and is designed to be used with a large diameter pipe and a small diameter pipe. Packer 70 includes resilient body 72, upper plate 74, lower plate 76 and insert segments 78.

In all of the packers of the present invention the interior of the resilient packer body is provided in its face recess with an undercut portion, such as indicated at 80 in FIG. 8, immediately above the inner surface of the lower plate. This undercut or relief area allows the rubber on making sealing contact to flow into the relief area and thereby lower the rubber pressure across the packer face. By lowering the rubber pressure and improving the rubber flow, the relief area enhances the life of the packer and reduces the stresses in the inserts. It should be noted that while not shown, the present invention is readily adaptable to be used in a ram-type blowout preventer having provision for closing on two strings rather than only one string as hereinbefore described. The improved packer of the present invention may be used for two strings merely by including insert segments as described above around both of the central face recesses of the packer.

The use of the insert segments in the improved packer of the present invention contain the rubber and reduce the extrusion gap of the side of the packer opposite pressure to a few thousandths of an inch to provide a packer which can be used longer and successfully closed and sealed on the pipes having a diameter within the range of sizes served by the packer. The use of a bonding agent or the depending lips functions to ensure that the segments move with the resilient body in its retraction movement. The segments also move inwardly with the resilient body to be in supporting position when sealed against the exterior of a pipe having a diameter within the size range of the packer.

What is claimed is:

1. A variable bore packer for use in a front ram slot of a ram-type blowout preventer comprising a resilient body having a size to fit within the front slot of the ram in which it is to be positioned, an upper portion, a lower portion and an upper surface, and having a central recess on its front face, an upper plate positioned in the upper portion of the resilient body and having a recess on its front face and an under surface, a lower plate positioned in the lower portion of the resilient body and having a recess on its front face, a plurality of spaced apart, radially extending metal insert segments positioned between the upper surface of the resilient body and the under surface of the upper plate and around the central recess of the resilient body, said insert segments being embedded in said resilient body and having sufficient length to engage the exterior surface of a tubular member which is to be sealed against by the packer, said insert segments being selected to seat against a preselected small tubular member to provide anti-extrusion support for the resilient body against the small tubular member whose diameter is less than the diameter which could be sealed by the packer without the insert segments with the upper plate providing the sole anti-extrusion support for the resilient body.

2. A variable bore packer according to claim 1 wherein said insert segments are first insert segments and including a plurality of second spaced apart, insert segments positioned between said first insert segments and said resilient body and having sufficient length to extend to a smaller diameter to provide anti-extrusion support for said resilient body than the diameter at which said first insert segments provides such support.

3. A variable bore packer according to claim 1 including a relief area in the profile of the central recess of the resilient body immediately above the lower plate.

4. A variable bore packer according to claim 1 including a depending lip on the outer surface of each of said insert segments embedded in said resilient body.

* * * * *